US006868818B2

(12) United States Patent
Takahashi et al.

(10) Patent No.: US 6,868,818 B2
(45) Date of Patent: Mar. 22, 2005

(54) CONSTITUTION OF PROTECTING FUEL DELIVERY TUBE OF ENGINE

(75) Inventors: Hideo Takahashi, Yokohama (JP); Jun Harui, Tokyo (JP); Masatoshi Hada, Nagoya (JP)

(73) Assignees: Nissan Motor Co., Ltd., Yokohama (JP); Aichi Machine Industry Co., Ltd., Nagoya (JP); Renault s.a.s. societe par actions simplifiee, Boulogne-Billancourt (FR)

( * ) Notice: Subject to any disclaimer, the term of this patent is extended or adjusted under 35 U.S.C. 154(b) by 0 days.

(21) Appl. No.: 10/762,345

(22) Filed: Jan. 23, 2004

(65) Prior Publication Data

US 2004/0149267 A1 Aug. 5, 2004

(30) Foreign Application Priority Data

Jan. 24, 2003 (JP) ..... 2003-015908
Jul. 11, 2003 (JP) ..... 2003-195645

(51) Int. Cl.[7] ..... F02F 7/00
(52) U.S. Cl. ..... 123/195 A; 123/195 R
(58) Field of Search ..... 123/195 A, 195 C, 123/195 S, 195 H

(56) References Cited

U.S. PATENT DOCUMENTS 4,471,731 A * 9/1984 Kasting et al. ..... 123/90.38
4,793,299 A * 12/1988 Ishimura et al. ..... 123/195 R
6,076,505 A 6/2000 Guggenmos et al.

FOREIGN PATENT DOCUMENTS

EP 0 293 278 A1 11/1988
EP 1 304 473 A2 4/2003
JP 10-252588 A 9/1998

* cited by examiner

*Primary Examiner*—Bibhu Mohanty
(74) *Attorney, Agent, or Firm*—Foley & Lardner LLP

(57) ABSTRACT

A constitution of protecting a fuel delivery tube of an engine, includes: 1) an engine body including: a) a cylinder head, and b) a ladder cam bracket defining an outer wall on a side section thereof, including: i) an outer frame, ii) an intake cam bracket, and iii) an exhaust cam bracket integrated with the outer frame and holding an exhaust cam shaft; 2) the fuel delivery tube disposed beside the engine body and extending in a direction substantially along a row of a cylinder; and 3) an intake manifold made of a material free from a metal. The outer wall of the ladder cam bracket is formed with a protrusion which protrudes toward a branch section of the intake manifold in such a manner as to prevent the branch section of the intake manifold from causing an interference with the fuel delivery tube.

16 Claims, 9 Drawing Sheets

CONSTITUTION OF PROTECTING FUEL DELIVERY TUBE OF ENGINE

BACKGROUND OF THE INVENTION

1. Field of the Invention

The present invention relates to a constitution of protecting fuel delivery tube of an engine.

2. Description of the Related Art

Japanese Patent Unexamined Publication No. Heisei 10 (1998)-252588 (=JP10252588) entitled "INTAKE DEVICE FOR AUTOMOBILE ENGINE" by its English abstract discloses a connection between an intake manifold and a throttle body. With high rigidity, the connection is fixed to an engine body by a pair of brackets which extend (or expand) in such a manner as to form a Japanese katakana character "ハ" in a side view (see FIG. 1) toward an engine body. The connection thus fixed to the engine body can securely prevent the throttle body from moving in a vehicular collision, thereby preventing the throttle body from damaging (or causing an interference with) a fuel delivery tube.

BRIEF SUMMARY OF THE INVENTION

It is an object of the present invention to provide a constitution of protecting a fuel delivery tube of an engine.

It is another object of the present invention to provide a protrusion for the constitution which protrusion is so formed as to protrude from an outer wall on a side section of a ladder cam bracket toward a branch section's side of an intake manifold, thus preventing the branch section from causing an interference with the fuel delivery tube.

According to an aspect of the present invention, there is provided a constitution of protecting a fuel delivery tube of an engine, comprising:

1) an engine body including:
   a) a cylinder head, and
   b) a ladder cam bracket tightened onto the cylinder head and defining an outer wall on a side section thereof, the ladder cam bracket including:
      i) an outer frame,
      ii) an intake cam bracket integrated with the outer frame and holding an intake cam shaft, and
      iii) an exhaust cam bracket integrated with the outer frame and holding an exhaust cam shaft;
2) the fuel delivery tube disposed beside the engine body and extending in a direction substantially along a row of a cylinder; and
3) an intake manifold made of a material free from a metal and including a branch section which is disposed in such a manner as to oppose the engine body with respect to the fuel delivery tube.

The outer wall of the ladder cam bracket is formed with a protrusion which protrudes toward the branch section of the intake manifold in such a manner as to prevent the branch section of the intake manifold from causing an interference with the fuel delivery tube.

The other object(s) and feature(s) of the present invention will become understood from the following description with reference to the accompanying drawings.

DETAILED DESCRIPTION OF THE EMBODIMENT

In the following, various embodiments of the present invention will be described in detail with reference to the accompanying drawings.

For ease of understanding, the following description will contain various directional terms, such as, left, right, upper, lower, forward, rearward and the like. However, such terms are to be understood with respect to only a drawing or drawings on which the corresponding part of element is illustrated.

Constitution—First Embodiment

As is seen in FIG. 1 to FIG. 4, there is provided a constitution of protecting a fuel delivery tube 5 of an engine, according to a first embodiment of the present invention.

Figure 1:
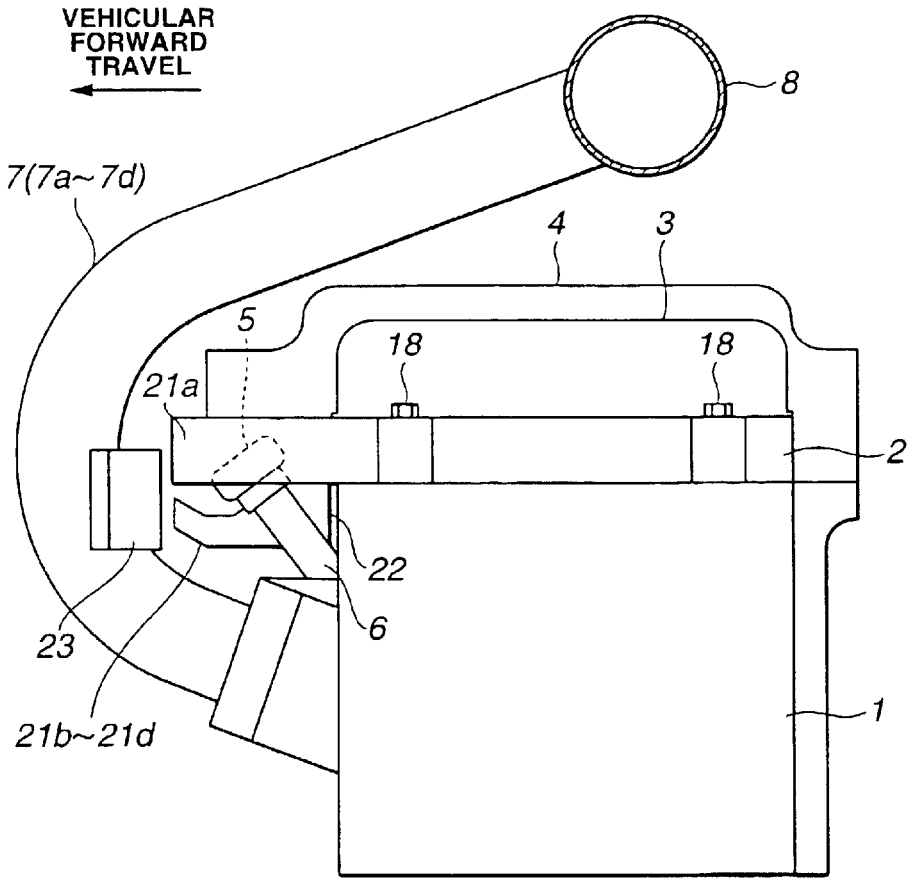
FIG. 1 is a rear view of an engine, according to a first embodiment of the present invention.

FIG. 1 is a rear view of the engine.

Figure 2:
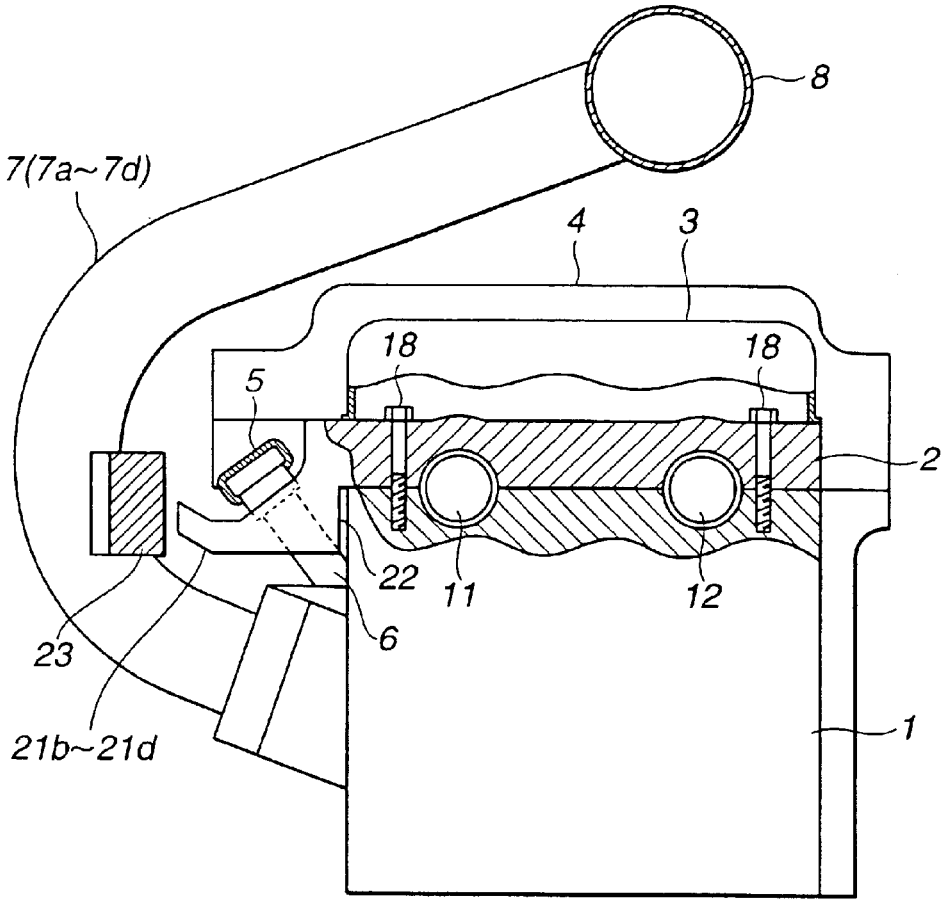
FIG. 2 is a cross sectional view of an essential part of the rear view of the engine, according to the first embodiment.

FIG. 2 is a cross sectional view of an essential part of the rear view of the engine.

Figure 3:
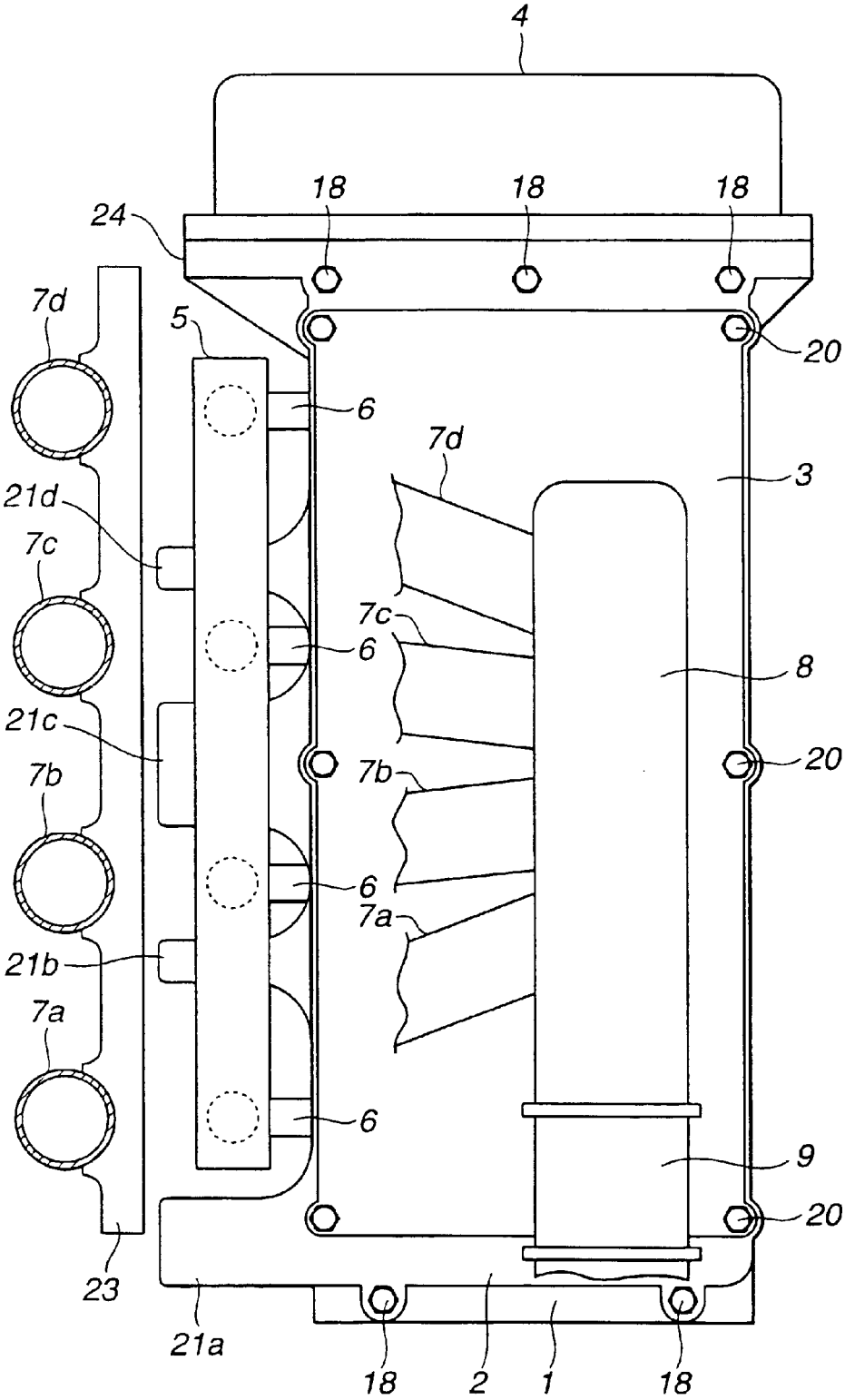
FIG. 3 is a plan view of the engine, according to the first embodiment.

FIG. 3 is a plan view of the engine.

Figure 4:
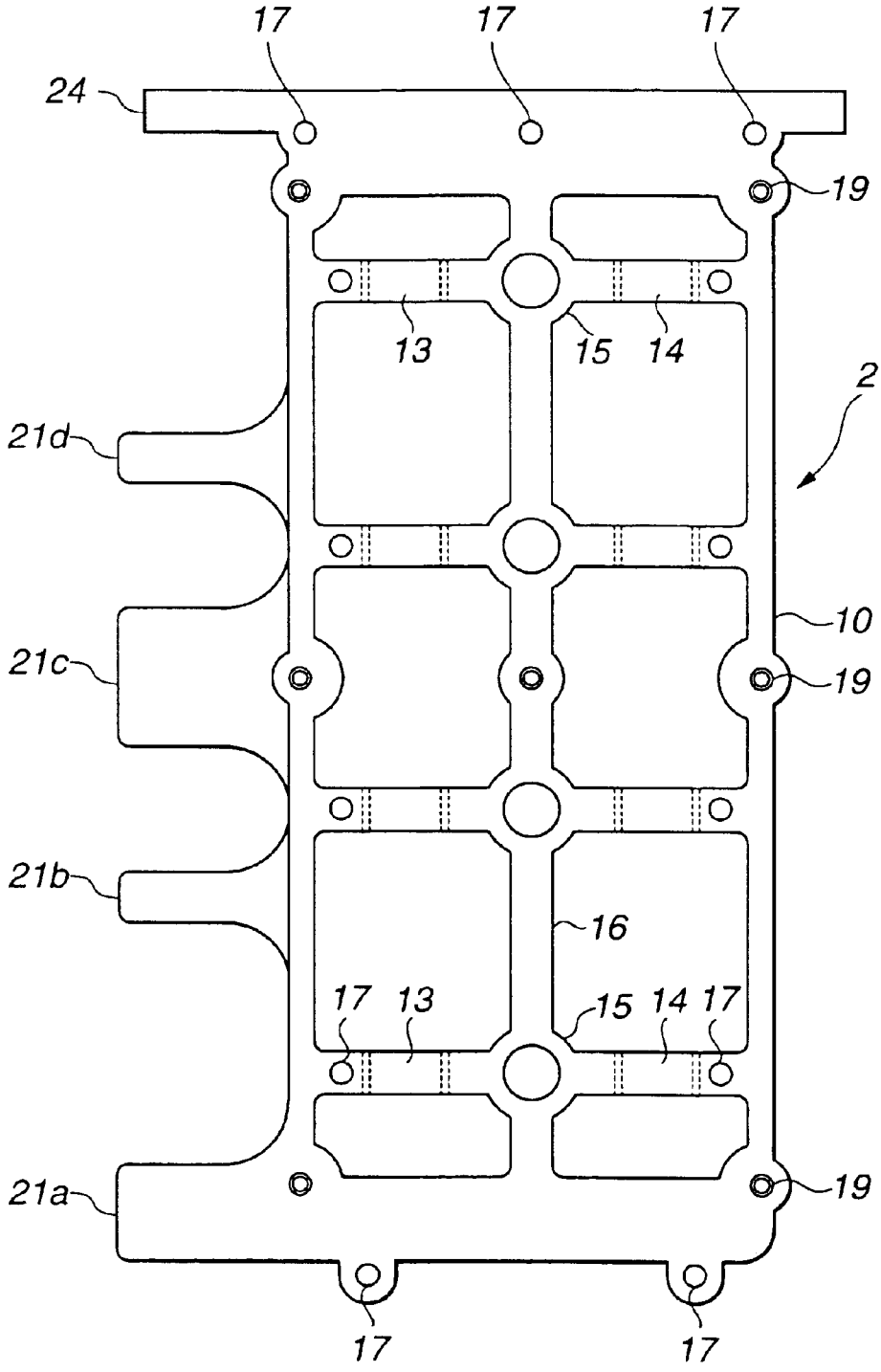
FIG. 4 is a plan view of a ladder cam bracket 2, according to the first embodiment.

FIG. 4 is a plan view of a ladder cam bracket 2.

An engine body is constituted of a cylinder block (not shown), a cylinder head 1, ladder cam bracket 2, a rocker cover 3, a front cover 4 and the like.

The engine body is mounted substantially sidewise relative to a vehicular body, with its intake side disposed frontward and its exhaust side disposed rearward. Thereby, the engine body (cylinder head 1)'s front side is connected to an intake manifold 7, while the engine body (cylinder head 1)'s rear side is connected to an exhaust manifold (not shown).

The engine has a fuel system. More specifically, fuel delivery tube 5 having a cross section shaped substantially into a low profile (see FIG. 1 and FIG. 2) is disposed beside the intake side (front side of the vehicle) of the engine body (cylinder head 1) in such a manner as to extend in a direction substantially along a row of cylinders. There is provided a fuel injection valve 6 for one of the respective cylinders. A first end (upper and left in FIG. 1 and FIG. 2) of each of the fuel injection valves 6 is securely connected to a lower face of fuel delivery tube 5, such that a second end (lower and right in FIG. 1 and FIG. 2) of fuel injection valve 6 can face an intake port (left in FIG. 1 and FIG. 2) of cylinder head 1.

Intake manifold 7 made of a synthetic resin and the like includes:

1. a branch section 7*a*, a branch section 7*b*, a branch section 7*c* and a branch section 7*d* (for the respective cylinders) connected to the intake port of cylinder head 1, and
2. a collector section 8 for collecting branch section 7*a*, branch section 7*b*, branch section 7*c* and branch section 7*d* together on an upstream side.

Herein, each of branch section 7*a*, branch section 7*b*, branch section 7*c* and branch section 7*d* is deformed in such a manner as to extend to an opposite side of the engine body (cylinder head 1) with respect to fuel delivery tube 5, with an upstream side of each of branch section 7*a*, branch section 7*b*, branch section 7*c* and branch section 7*d* ending above the engine body (rocker cover 3).

Collector section 8 disposed above the engine body (rocker cover 3) extends in the direction substantially along the row of the cylinders, with a first end (lower in FIG. 3) of collector section 8 having an inlet opening connected to a throttle body 9, as is seen in FIG. 3.

Throttle body 9 disposed above the engine body (rocker cover 3) can achieve a flexible lay out of intake manifold 7, thereby improving output performance.

Described below is the constitution of protecting fuel delivery tube 5 in case of a vehicular collision.

Described at first is ladder cam bracket 2.

Ladder cam bracket 2 is an integration of an outer frame 10 with a plurality of intake cam brackets 13 and a plurality of exhaust cam brackets 14 holding respectively an intake cam shaft 11 and an exhaust cam shaft 12.

More specifically about this: Intake cam bracket 13 for holding intake cam shaft 11 and exhaust cam bracket 14 for holding exhaust cam shaft 12 are integrated in such a manner as to be connected with a plug tower section 15 {for inserting therein an ignition plug {not shown)} disposed therebetween, as is seen in FIG. 4. Intake cam bracket 13 and exhaust cam bracket 14 thus integrated are further integrated with a rib 16 (connecting adjacent two of the plug tower sections 15), thus constituting ladder cam bracket 2.

Ladder cam bracket 2 having the integrated constitution as described above can reduce the number of parts, resulting in improved machinability, assembly and the like of ladder cam bracket 2.

Moreover, ladder cam bracket 2 increasing rigidity of holding intake cam bracket 13 and exhaust cam bracket 14 can reduce vibration noise which may be caused in an operation of a valve driving system.

Ladder cam bracket 2 tightened to cylinder head 1 can be a solid integrated constitution. More specifcailly about this: A cam journal is formed with intake cam bracket 13, exhaust cam bracket 14 and cylinder head 1. An inner part of the cam journal is tightened with intake cam shaft 11 and exhaust cam shaft 12.

In addition to a tightening strength brought about by a plurality of bolts 18, as is seen in FIG. 3, ladder cam bracket 2 can obtain a great tightening strength against a load which may be applied substantially horizontally in the vehicular collision.

Hereinabove, rocker cover 3 can be securely bolted to ladder cam bracket 2 by means of bolts 20 screwed into a plurality of holes 19 defined in ladder cam bracket 2.

The constitution of protecting fuel delivery tube 5 is described as below:

A plurality of a protrusion 21*a*, a protrusion 21*b*, a protrusion 21*c* and a protrusion 21*d* protrude respectively from a plurality of positions. Herein, the above positions are disposed in the direction substantially along the row of the cylinders and are arranged on a side section (the intake side, namely, left in FIG. 3) of ladder cam bracket 2 in the vicinity of fuel delivery tube 5, in such a manner as to avoid fuel injection valves 6. Protrusion 21*a*, protrusion 21*b*, protrusion 21*c* and protrusion 21*d* extend toward a side of branch section 7*a*, branch section 7*b*, branch section 7*c* and branch section 7*d* in such a manner as to avoid contact with fuel delivery tube 5.

Protrusion 21*a* is in the vicinity of a rear side (lower in FIG. 3) of the engine. The rear side {namely, outside an end (lowest end in FIG. 3) of fuel delivery tube 5 extending in the direction substantially along the row of the cylinders} of the engine is free from fuel delivery tube 5 and fuel injection valve 6, thus allowing protrusion 21*a* to protrude substantially straightly from an outer wall on a side section of outer frame 10 of ladder cam bracket 2.

Each of protrusion 21*b*, protrusion 21*c* and protrusion 21*d* disposed between adjacent two of fuel injection valves 6 in the direction substantially along the row of the cylinders protrudes in such a manner as to stride below fuel delivery tube 5, as is seen in FIG. 1 and FIG. 2. Moreover, each of protrusion 21*b*, protrusion 21*c* and protrusion 21*d* defines a back face section 22 (otherwise referred to as "abutment section") facing an outer wall on a side section of cylinder head 1. A certain clearance (a minimum adjustment play for assembling ladder cam bracket 2 to cylinder head 1) is defined between back face section 22 and the outer wall on the side section of cylinder head 1.

Of protrusion 21*a*, protrusion 21*b*, protrusion 21*c* and protrusion 21*d*, protrusion 21*c* that is disposed substantially in the center in the direction substantially along the row of the cylinders is wider than protrusion 21*a*, protrusion 21*b* and protrusion 21*d*, as is seen in FIG. 3 and FIG. 4.

A rod member 23 profiled substantially into an arch is fixed to (or integrated with) intake manifold 7's side. More specifically, rod member 23 connects the plurality of branch section 7*a*, branch section 7*b*, branch section 7*c* and branch section 7*d* in the direction substantially along the row of the cylinders, and faces the plurality of protrusion 21*a*, protrusion 21*b*, protrusion 21*c* and protrusion 21*d*. Rod member 23 has a first end (lower in FIG. 3) and a second end (upper in FIG. 3) extending respectively beyond branch section 7*a* and branch section 7*d*, with the first end (lower in FIG. 3) corresponding to protrusion 21*a* and the second end (upper in FIG. 3) corresponding to a mount flange 24 for mounting the front cover 4.

In the vehicular collision, a collision energy may be partly applied from the front side (left in FIG. 1 to FIG. 4) of the vehicle to intake manifold 7. Intake manifold 7 made, for example, of resin is likely to move rearward (rightward in FIG. 1 to FIG. 4) comparatively with ease. In this state, however, the strong rod member 23 (which is profiled substantially into the arch) connecting the plurality of branch section 7*a*, branch section 7*b*, branch section 7*c* and branch section 7*d* of intake manifold 7 may abut on the plurality of protrusion 21*a*, protrusion 21*b*, protrusion 21*c* and protrusion 21*d*, thus restricting a further rearward movement of intake manifold 7, resulting in prevention of an interference which may have been caused by rod member 23 (intake manifold 7) with fuel injection valve 6 and fuel delivery tube 5.

As described above, ladder cam bracket 2 by itself has a great strength and the integrated constitution, moreover, ladder cam bracket 2 integrated with cylinder head 1 is also rigid, bringing about a sufficient rigidity against the load which may be applied substantially horizontally by way of protrusion 21*a*, protrusion 21*b*, protrusion 21*c* and protrusion 21*d* in the vehicular collision.

In a state of a great energy caused in the vehicular collision, protrusion 21*b*, protrusion 21*c* and protrusion 21*d* of ladder cam bracket 2 are likely to move rearward. In this state, however, a further rearward movement of protrusion 21*b*, protrusion 21*c* and protrusion 21*d* can be restricted by abutment of respective back face sections 22 thereof on the outer wall on the side section of cylinder head 1, resulting in prevention of the interference which may have been caused by rod member 23 (intake manifold 7) with fuel injection valve 6 and fuel delivery tube 5.

According to the first embodiment of the present invention, the constitution of protecting fuel delivery tube 5 of the engine includes;

1) the engine body including cylinder head 1 onto which ladder cam bracket 2 is tightened, ladder cam bracket 2 having outer frame 10 integrated with:
   i) intake cam bracket 13 holding intake cam shaft 11, and
   ii) exhaust cam bracket 14 holding exhaust cam shaft 12;
2) fuel delivery tube 5 disposed beside the engine body and extending in the direction substantially along the row of the cylinders; and
3) intake manifold 7 made of a material free from a metal and including branch section 7*a*, branch section 7*b*, branch section 7*c* and branch section 7*d* which are disposed in such a manner as to oppose the engine body with respect to fuel delivery tube 5.

In the above constitution, ladder cam bracket 2 defines the outer wall on the side section thereof. The outer wall of ladder cam bracket 2 is formed with protrusion 21*a*, protrusion 21*b*, protrusion 21*c* and protrusion 21*d* protruding toward the side of branch section 7*a*, branch section 7*b*, branch section 7*c* and branch section 7*d* in such a manner as to prevent branch section 7*a*, branch section 7*b*, branch section 7*c* and branch section 7*d* of intake manifold 7 from causing the interference with fuel delivery tube 5.

Effect and Operation—First Embodiment

With the above constitution according to the first embodiment, branch section 7*a*, branch section 7*b*, branch section 7*c* and branch section 7*d* of intake manifold 7 can be prevented from causing the interference with fuel delivery tube 5 even if deformation of intake manifold 7 in the vehicular collision is increased.

By way of bolt 18, intake cam shaft 11 and exhaust cam shaft 12, the energy in the vehicular collision can be conveyed to and absorbed by cylinder head 1, the constitution thereby can endure a greater mechanical shock.

Moreover, integrating protrusion 21*a*, protrusion 21*b*, protrusion 21*c* and protrusion 21*d* (for protecting fuel delivery tube 5) with ladder cam bracket 2 can eliminate the need of assembly thereof, thus improving the workability.

Although deformation of protrusion 21*a*, protrusion 21*b*, protrusion 21*c* and protrusion 21*d* of ladder cam bracket 2 is expected to replace ladder cam bracket 2, cylinder head 1 can be used without its replacement.

According to the first embodiment, ladder cam bracket 2 in the vicinity of fuel delivery tube 5 can minimize protrusion 21*a*, protrusion 21*b*, protrusion 21*c* and protrusion 21*d* in size, thereby lowering weight and cost.

Moreover, according to the first embodiment, pluralizing protrusions (namely, into protrusion 21*a*, protrusion 21*b*, protrusion 21*c* and protrusion 21*d*) can secure that intake manifold 7 is prevented from causing the interference with fuel delivery tube 5.

Moreover, according to the first embodiment, of the plurality of protrusion 21*a*, protrusion 21*b*, protrusion 21*c* and protrusion 21*d*, 1) protrusion 21*a* protrudes from outside the end (lowest end in FIG. 3) of fuel delivery tube 5 extending in the direction substantially along the row of the cylinders, while
2) protrusion 21*b*, protrusion 21*c* and protrusion 21*d* protrude in such a manner as to stride below fuel delivery tube 5, thus minimizing protrusion 21*a*, protrusion 21*b*, protrusion 21*c*, protrusion 21*d* in size and achieving preferred and smooth mounting and dismounting of fuel delivery tube 5.

Moreover, according to the first embodiment, at least a part of the plurality of protrusion 21*a*, protrusion 21*b*, protrusion 21*c* and protrusion 21*d*, namely, protrusion 21*b*, protrusion 21*c* and protrusion 21*d* have respective back face sections 22 facing the outer wall on the side section of cylinder head 1 at the certain clearance, thus allowing the constitution endurable against the great mechanical shock.

Moreover, according to the first embodiment, of protrusion 21*a*, protrusion 21*b*, protrusion 21*c* and protrusion 21*d*, protrusion 21*c* that is disposed substantially in the center in the direction substantially along the row of the cylinders is wider than protrusion 21*a*, protrusion 21*b* and protrusion 21*d*, thus strengthening a section subjected to the great mechanical shock, resulting in an effective shock absorbing with a small amount of material.

Moreover, according to the first embodiment, the plurality of branch section 7*a*, branch section 7*b*, branch section 7*c* and branch section 7*d* (of intake manifold 7) connected in the direction substantially along the row of the cylinders and rod member 23 facing the plurality of protrusion 21*a*, protrusion 21*b*, protrusion 21*c* and protrusion 21*d* can improve rigidity of intake manifold 7 and disperse the mechanical shock in the vehicular collision. In addition, layout of protrusion 21*a*, protrusion 21*b*, protrusion 21*c* and protrusion 21*d* can be made flexible.

Constitution—Second Embodiment

As is seen in FIG. 5 to FIG. 10, there is provided the constitution of protecting the fuel delivery tube 5 of the engine, according to a second embodiment of the present invention.

Figure 5:
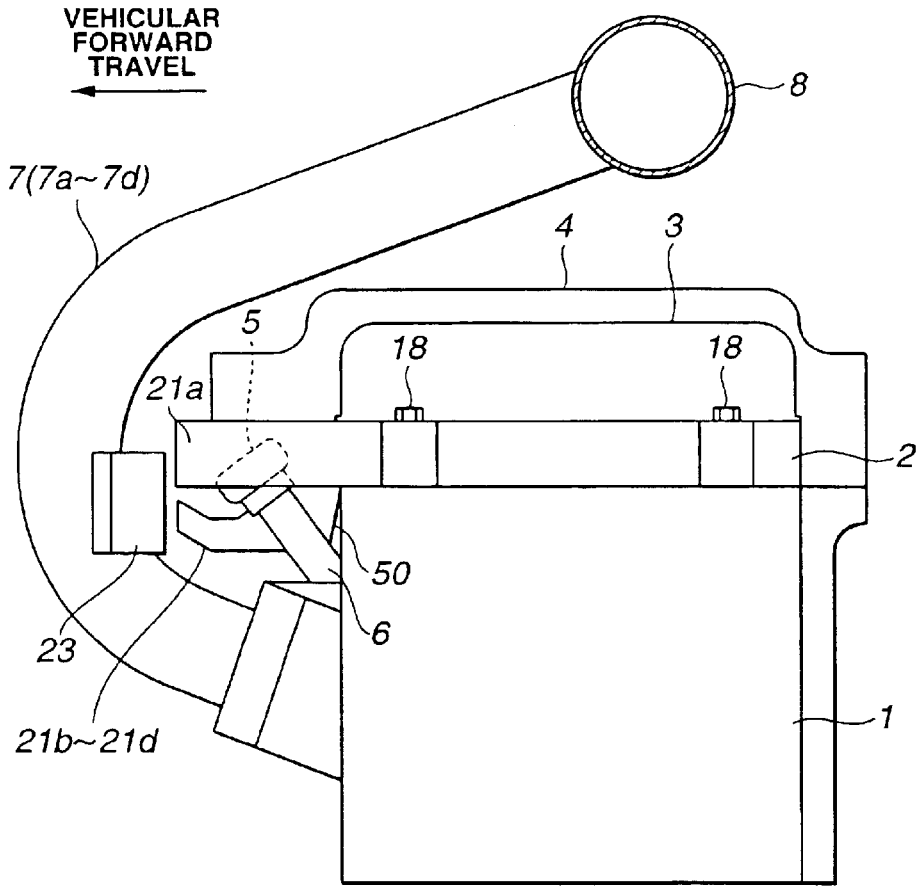
FIG. 5 is a rear view of the engine, according to a second embodiment of the present invention.

FIG. 5 is a rear view of the engine.

Figure 6:
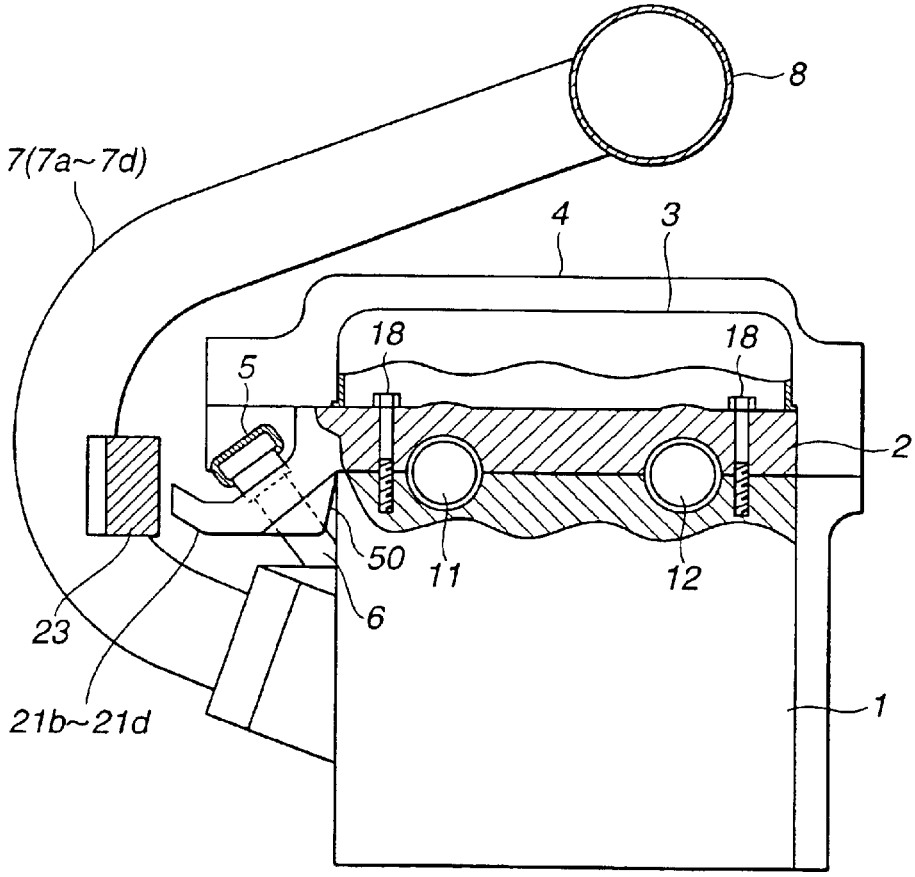
FIG. 6 is a cross sectional view of an essential part of the rear view of the engine, according to the second embodiment.

FIG. 6 is a cross sectional view of an essential part of the rear view of the engine.

Figure 7:
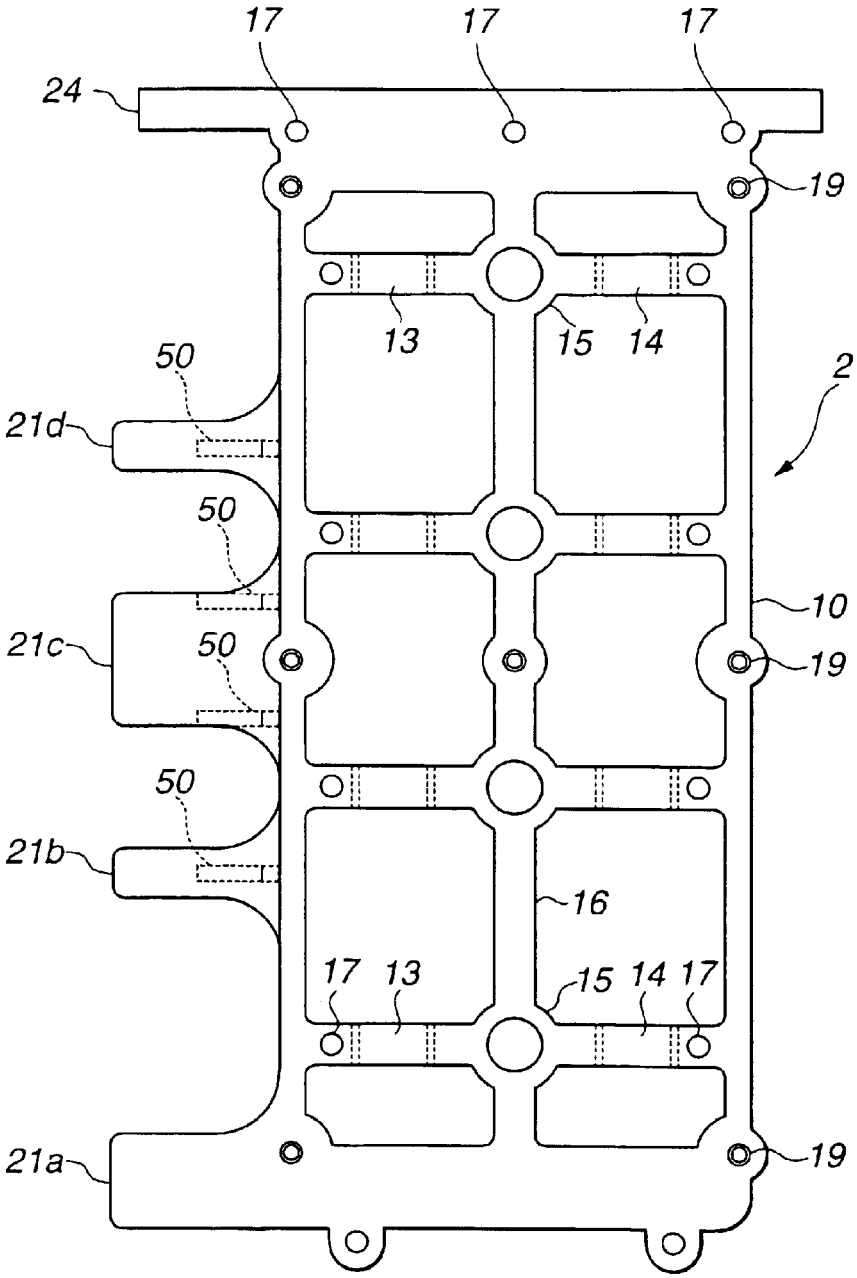
FIG. 7 is a plan view of ladder cam bracket 2, according to the second embodiment.

FIG. 7 is a plan view of ladder cam bracket 2.

Figure 8:
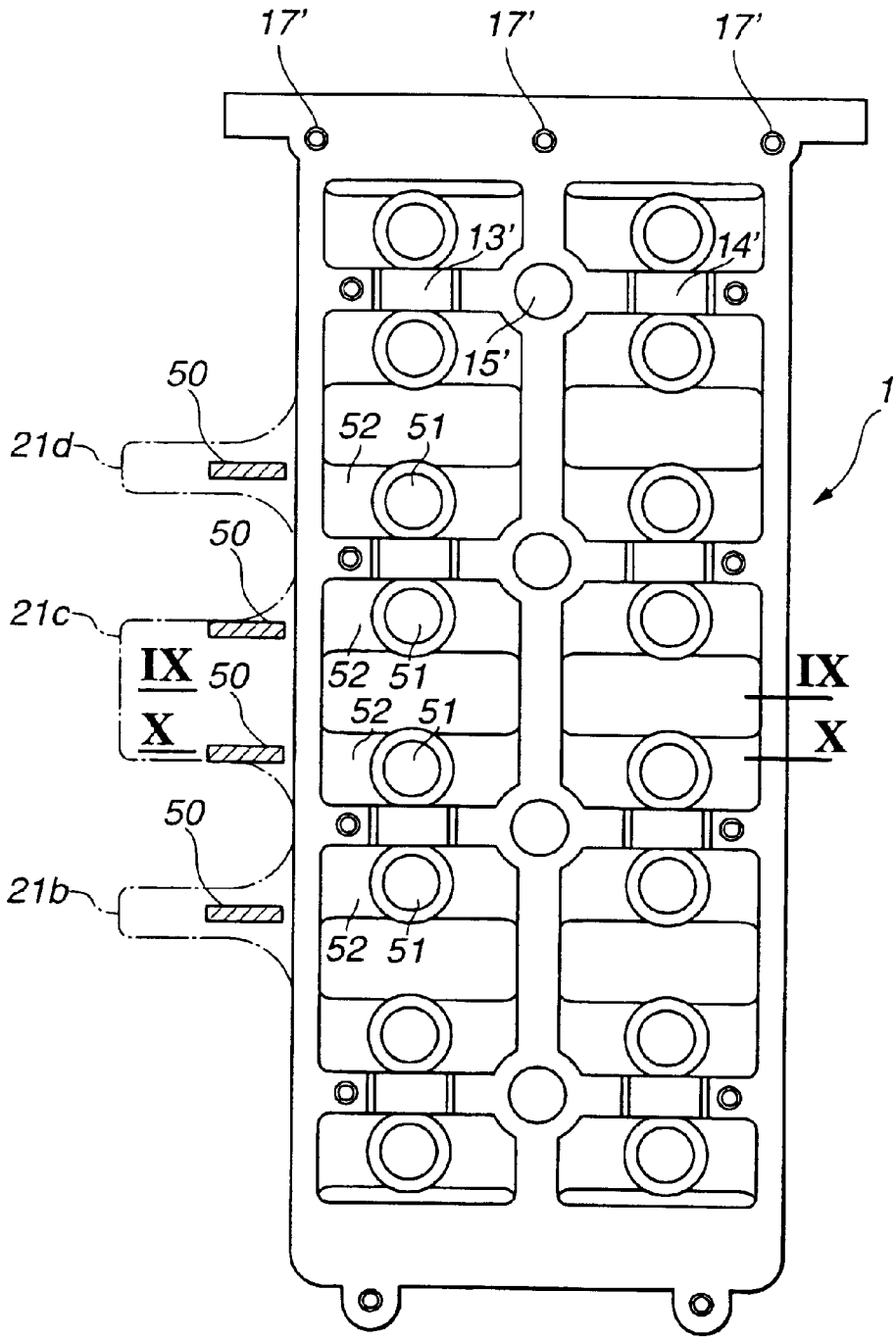
FIG. 8 is a plan view of cylinder head 1, according to the second embodiment.

FIG. 8 is a plan view of cylinder head 1.

Figure 9:
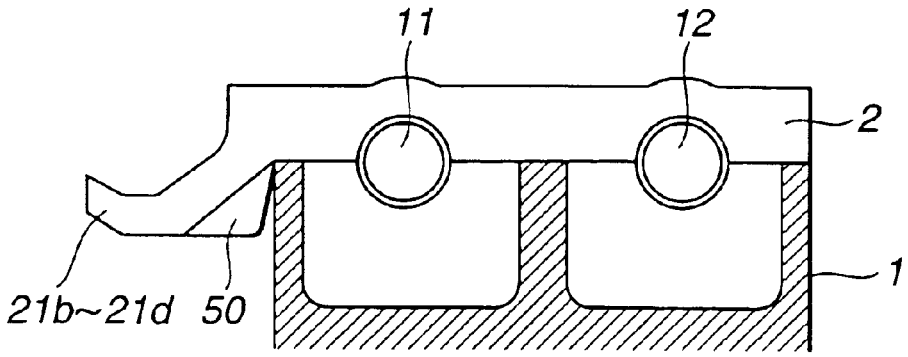
FIG. 9 is a view taken along the lines IX—IX in FIG. 8, according to the second embodiment.

FIG. 9 is a view taken along the lines IX—IX in FIG. 8.

Figure 10:
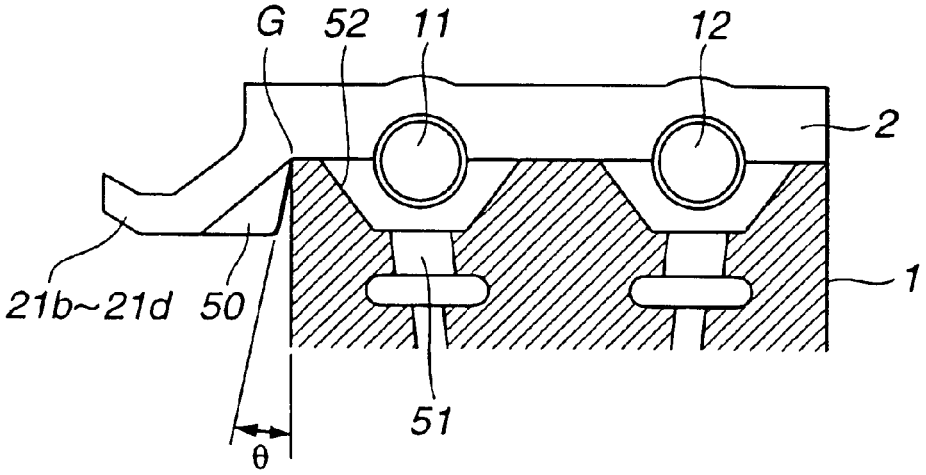
FIG. 10 is a view taken along the lines X—X in FIG. 8, according to the second embodiment.

FIG. 10 is a view taken along the lines X—X in FIG. 8.

Each of protrusion 21*b*, protrusion 21*c* and protrusion 21*d* of ladder cam bracket 2 bends and extends in such a mariner as to stride below fuel delivery tube 5. On a lower face of each of protrusion 21*b*, protrusion 21*c* and protrusion 21*d*, there is provided a back face rib 50 (referred to as "back face section" and "back face rib" in WHAT IS CLAIMED IS) shaped substantially into a triangle in FIG. 5. Back face rib 50 is smaller in width than each of protrusion 21*b*, protrusion 21*c* and protrusion 21*d* in the direction substantially along the row of the cylinders, as is seen in FIG. 7 and FIG. 8. Back face rib 50 works as a back face section facing the outer wall (on the side of cylinder head 1), defining a certain clearance between back face rib 50 and the outer wall on the side of cylinder head 1.

As is seen in FIG. 8, on the outer wall on the side section of cylinder head 1, each of back face ribs 50 substantially serially corresponds to one of lifter bore sides 52 in cylinder head 1. A lifter bore 51 is a hole for guiding a valve lifter (not shown) in such a manner that the valve lifter (not shown) can slide. Hereinabove, the valve lifters (not shown) are to be mounted to ends of an intake valve (not shown) and an exhaust valve (not shown). Lifter bore side 52 connects to the outer wall on the side section of cylinder head 1 in such a manner as to form lifter bore 51. On the outer wall on the side section of cylinder head 1, a thick wall is formed in a section where back face rib 50 substantially serially corresponds to lifter bore side 52 in cylinder head 1.

More specifcailly about this:

FIG. 9 taken along the lines IX—IX in FIG. 8 shows a thin wall of the section free of lifter bore side 52, while FIG. 10 taken along the lines X—X in FIG. 8 shows the thick wall including lifter bore side 52.

An excessively great input so pressing protrusion 21*b*, protrusion 21*c* and protrusion 21*d* as to allow back face ribs 50 to abut on the outer wall on the side section of cylinder head 1 may break cylinder head 1, if cylinder head 1 is low in rigidity.

According to the first embodiment, the thick wall including lifter bore side 52 (FIG. 10) as described above is high in rigidity, or at least higher in rigidity than other sections (FIG. 9 and the like) of cylinder head 1, bringing about a sufficiently high durability. With this, even if the above excessively great input may cause the abutment of back face rib 50 on the side section of cylinder head 1, the thick wall is endurable.

FIG. 8 showing the plan view of cylinder head 1 also shows a first cam journal 13', a second cam journal 14', a plug tower section 15', and a hole 17' (screw hole) for mounting ladder cam bracket 2.

As is indicated by an angle θ in FIG. 10, lower part of back face rib 50 is so inclined as to become more spaced apart from the outer wall on the side section of cylinder head 1.

The mechanical shock applied to protrusion 21*b*, protrusion 21*c* and protrusion 21*d* striding below fuel delivery tube 5 may cause such a moment as to turn each of protrusion 21*b*, protrusion 21*c* and protrusion 21*d* around an edge G in FIG. 10. The inclination (defined by angle θ) of back face rib 50's face facing cylinder head 1 can allow back face rib 50 to abut on the outer wall on the side section of cylinder head 1 in the above turning. More specifically, the above abutment is made face-to-face, thus preventing stress concentration.

Middle protrusion 21*c* wider than protrusion 21*b* and protrusion 21*d* is formed with two back face ribs 50 at both two ends substantially in the widthwise direction. With the above constitution, protrusion 21*c* can secure the rigidity while achieving a light weight by casting out a center section thereof.

Each of protrusion 21*b* and protrusion 21*d* is formed with one back face rib 50 substantially in the center substantially in the widthwise direction. With the above constitution, each of protrusion 21*b* and protrusion 21*d* can secure the rigidity while achieving a light weight by casting out both ends thereof.

Effect and Operation—Second Embodiment

According to the second embodiment, on the outer wall on the side section of cylinder head 1, back face rib 50 substantially serially corresponds to the lifter bore side 52 in cylinder head 1. With the above constitution, back face rib 50 can abut on cylinder head 1's section (namely, the outer wall on the side section of cylinder head 1) that has high rigidity, thus preventing crack and the like from occurring to cylinder head 1.

According to the second embodiment, the inclination (defined by angle θ) of back face rib 50 is so formed as to allow the lower part of back face rib 50 to become more spaced apart from the outer wall on the side section of cylinder head 1. With the mechanical shock applied to protrusion 21*b*, protrusion 21*c* and protrusion 21*d*, back face rib 50 having the above constitution may have the face-to-face abutment on the outer wall on the side section of cylinder head 1, thus preventing the stress concentration.

According to the second embodiment, back face rib 50 is smaller in width than each of protrusion 21*b*, protrusion 21*c* and protrusion 21*d* in the direction substantially along the row of the cylinders, thus restricting weight increase of protrusion 21*b*, protrusion 21*c* and protrusion 21*d*.

According to the second embodiment, one back face rib 50 is formed substantially in the center substantially in the widthwise direction (protrusion 21*b* and protrusion 21*d*), and two back face ribs 50 are formed at both two ends substantially in the widthwise direction (protrusion 21*c*). This is weight-efficient for forming the back face rib 50 in accordance with the width of the protrusions 21*b*, protrusion 21*c* and protrusion 21*d*.

Although the present invention has been described above by reference to a certain embodiment, the present invention is not limited to the embodiment described above. Modifications and variations of the embodiment described above will occur to those skilled in the art, in light of the above teachings.

More specifically, according to the first embodiment and the second embodiment, the description of the engine with a frontward intake and rearward exhaust system is given. The present invention is also applicable to an engine with a frontward exhaust and rearward intake system, bringing about substantially the same effect as that obtained by the first embodiment and the second embodiment. In the frontward exhaust and rearward intake system, the intake manifold 7 may abut on a dash panel by rearward movement of the engine body in the vehicular collision.

This application is based on a prior Japanese Patent Application No. P2003-015908 (filed on Jan. 24, 2003 in Japan) and a prior Japanese Patent Application No. P2003-195645 (filed on Jul. 11, 2003 in Japan). The entire contents of the Japanese Patent Application No. P2003-015908 from which priority is claimed and the Japanese Patent Application No. P2003-195645 are incorporated herein by reference, in order to take some protection against mistranslation or omitted portions.

The scope of the present invention is defined with reference to the following claims.

What is claimed is:

1. A constitution of protecting a fuel delivery tube of an engine, comprising:

1) an engine body including:

a) a cylinder head, and b) a ladder cam bracket tightened onto the cylinder head, the ladder cam bracket including:

i) an outer frame, ii) an intake cam bracket integrated with the outer frame and holding an intake cam shaft, and iii) an exhaust cam bracket integrated with the outer frame and holding an exhaust cam shaft;

2) the fuel delivery tube disposed beside the engine body and extending in a direction substantially along a row of a cylinder; and 3) an intake manifold made of a material free from a metal and including a branch section which is disposed in such a manner as to oppose the engine body with respect to the fuel delivery tube, wherein the ladder cam bracket defines an outer wall on a side section thereof, and the outer wall of the ladder cam bracket is formed with a protrusion which protrudes toward the branch section of the intake manifold in such a manner as to prevent the branch section of the intake manifold from causing an interference with the fuel delivery tube.

2. The constitution of protecting the fuel delivery tube of the engine as claimed in claim 1, wherein the ladder cam bracket is disposed in a vicinity of the fuel delivery tube.

3. The constitution of protecting the fuel delivery tube of the engine as claimed in claim 1, wherein the constitution includes a plurality of the protrusions.

4. The constitution of protecting the fuel delivery tube of the engine as claimed in claim 3, wherein the plurality of the protrusions include:

1) a first protrusion protruding from outside an end of the fuel delivery tube extending in the direction substantially along the row of the cylinder, and 2) a second protrusion protruding in such a manner as to stride below the fuel delivery tube.

5. The constitution of protecting the fuel delivery tube of the engine as claimed in claim 3, wherein at least one of the plurality of the protrusions is formed with a back face section which causes a certain clearance to be defined between the back face section and an outer wall on a side section of the cylinder head.

6. The constitution of protecting the fuel delivery tube of the engine as claimed in claim 5, wherein on the outer wall on the side section of the cylinder head, the back face section substantially serially corresponds to a lifter bore side in the cylinder head.

7. The constitution of protecting the fuel delivery tube of the engine as claimed in claim 5, wherein the back face section is inclined in such a manner that a lower section thereof becomes more spaced apart from the outer wall on the side section of the cylinder head.

8. The constitution of protecting the fuel delivery tube of the engine as claimed in claim 5, wherein the second protrusion is formed with a protruding back face rib as the back face section, the back face rib being smaller in width than the second protrusion in the direction substantially along the row of the cylinder.

9. The constitution of protecting the fuel delivery tube of the engine as claimed in claim 8, wherein the back face rib includes:

1) one back face rib formed substantially in a center substantially in a widthwise direction of the protrusion, and 2) two back face ribs formed respectively at both two ends substantially in the widthwise direction of the protrusion.

10. The constitution of protecting the fuel delivery tube of the engine as claimed in claim 3, wherein of the plurality of the protrusions, the protrusion that is disposed substantially in a center in the direction substantially along the row of the cylinder is wider than the other protrusions.

11. The constitution of protecting the fuel delivery tube of the engine as claimed in claim 1, further comprising:

a rod member which connects a plurality of the branch sections of the intake manifold in the direction substantially along the row of the cylinder, and faces protrusions.

12. The constitution of protecting the fuel delivery tube of the engine as claimed in claim 1, further comprising an exhaust manifold, wherein in a direction of a vehicle, the intake manifold is disposed frontward while the exhaust manifold is disposed rearward relative to the intake manifold.

13. The constitution of protecting the fuel delivery tube of the engine as claimed in claim 1, further comprising an exhaust manifold, wherein in a direction of a vehicle, the exhaust manifold is disposed frontward while the intake manifold is disposed rearward relative to the exhaust manifold.

14. The constitution of protecting the fuel delivery tube of the engine as claimed in claim 1, wherein the branch section is deformed in such a manner as to extend to an opposite side of the engine body with respect to the fuel delivery tube 5, with an upstream side of the branch section ending above the engine body.

15. The constitution of protecting the fuel delivery tube of the engine as claimed in claim 14, wherein a collector section disposed above the engine body extends in the direction substantially along the row of the cylinder, with a first end of the collector section having an inlet opening connected to a throttle body.

16. The constitution of protecting the fuel delivery tube of the engine as claimed in claim 15, wherein the throttle body connected to the intake manifold by way of the collector section is disposed above the engine body.

* * * * *